United States Patent [19]

Jones

[11] 4,393,521

[45] Jul. 19, 1983

[54] DISPOSABLE GARMENT SHIELD AND METHOD OF MANUFACTURE

[76] Inventor: Carolyn R. Jones, 2818 S. Poplar Way, Lake Oswego, Oreg. 97304

[21] Appl. No.: 250,918

[22] Filed: Apr. 6, 1981

[51] Int. Cl.[3] ..... A41D 27/12; D05B 97/00

[52] U.S. Cl. ..... 2/56; 112/262.1

[58] Field of Search ..... 2/56, 53, 54, 55, 57, 2/58; 112/262.1

[56] References Cited

U.S. PATENT DOCUMENTS

| | | | |
|---|---|---|---|
| 20,903 | 6/1891 | Kleinert . | |
| 21,120 | 10/1891 | Kleinert . | |
| 21,310 | 1/1892 | Kleinert . | |
| 21,662 | 6/1892 | Rindekoff . | |
| 1,465,073 | 8/1923 | Dupont . | |
| 1,478,907 | 12/1923 | Ogden . | |
| 1,897,952 | 2/1933 | Dupont . | |
| 1,912,178 | 5/1933 | Conoyers . | |
| 1,979,983 | 11/1934 | Meek | 2/53 |
| 2,004,511 | 6/1935 | Souther, Jr. | 2/53 |
| 2,005,232 | 6/1935 | Marsh | 2/53 |
| 2,344,781 | 3/1944 | Mullen | 2/53 |
| 2,434,830 | 1/1948 | Billins et al. | 2/56 |
| 2,438,771 | 3/1948 | Topjian | 2/53 |
| 2,654,888 | 10/1953 | Brighman | 2/53 |
| 2,747,193 | 5/1956 | Pulsifer | 2/56 |
| 3,001,201 | 9/1961 | Hauser | 2/56 |
| 3,141,174 | 7/1964 | Meier-Nieper | 2/53 |
| 3,145,391 | 8/1964 | Terrell, Jr. | 2/56 |
| 3,259,911 | 7/1966 | Terrell, Jr. | 2/56 |
| 3,315,677 | 4/1967 | Terrell, Jr. | 128/288 |
| 3,463,154 | 8/1969 | Hendrick | 128/287 |
| 3,588,916 | 6/1971 | Glatt | 2/53 |
| 3,727,237 | 4/1973 | Glatt | 2/56 |
| 3,881,490 | 5/1975 | Whitehead et al. | 128/287 |
| 4,023,571 | 5/1977 | Comerford et al. | 128/290 P |
| 4,059,114 | 11/1977 | Richards | 128/287 |

OTHER PUBLICATIONS

Miles Kimball, vol. 4, 1963, "Cast-Away-Disposable Shields".

*Primary Examiner*—Doris L. Troutman

*Attorney, Agent, or Firm*—Klarquist, Sparkman, Campbell, Leigh, Whinston & Dellett

[57] ABSTRACT

A disposable garment shield includes a base layer of fusible interfacing superimposed with a moisture barrier layer, a moisture absorbing layer and a porous plastic layer. The shield is formed in a hexagonal configuration facilitating easy production from sheet material. After superposition of the various layers, the shield is folded toward the moisture absorbing side and centrally secured with a staple or the like at a short distance from the fold line. The shield is then reversely folded, providing a form fitting depression or concavity adapting the shield to fit the underarm of the user.

28 Claims, 8 Drawing Figures

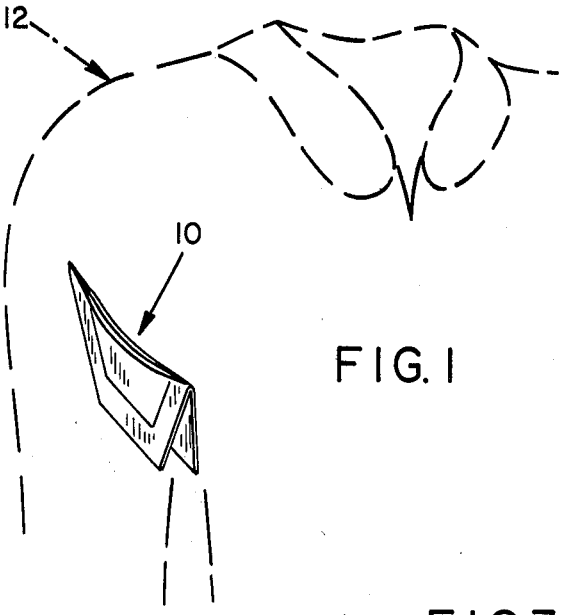
FIG. 1
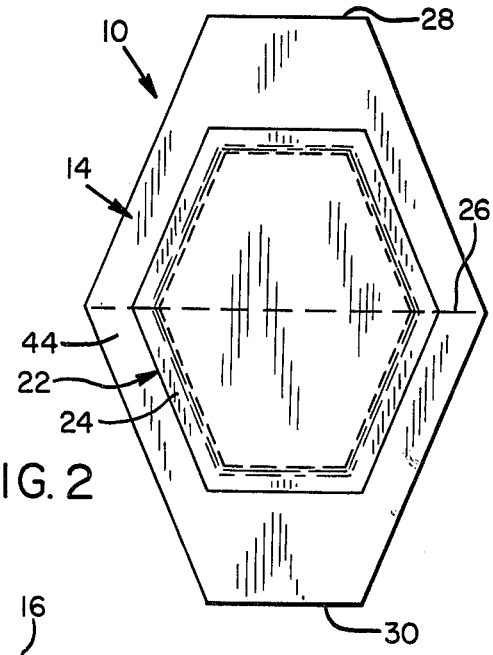
FIG. 2
FIG. 3
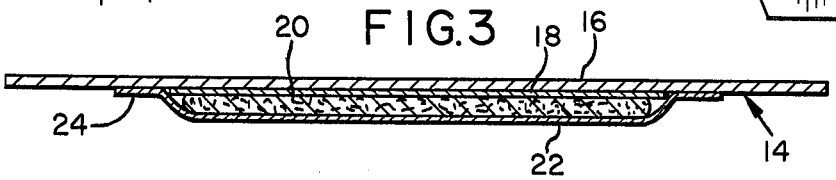
FIG. 4
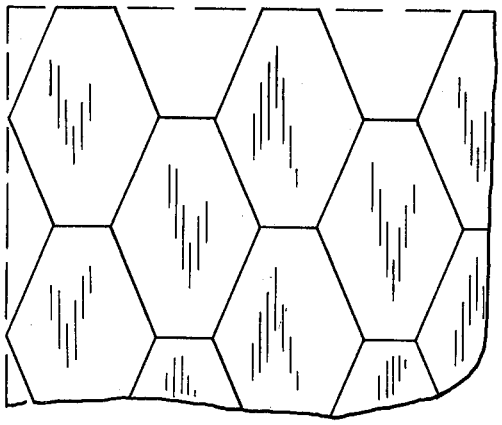
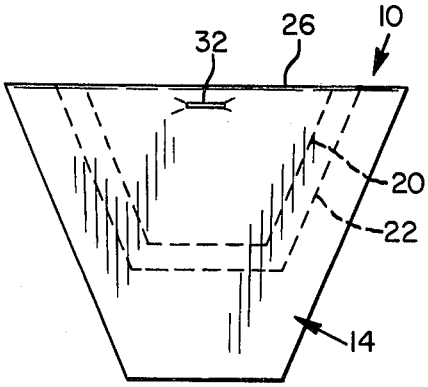
FIG. 5
FIG. 6
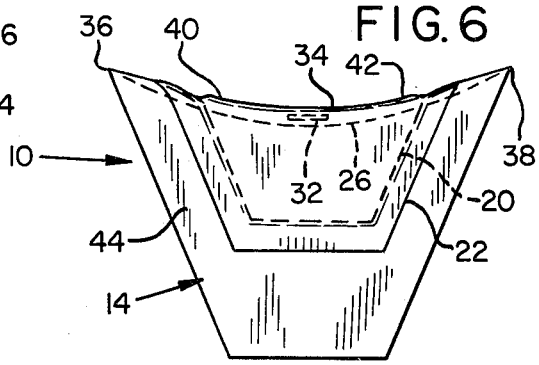
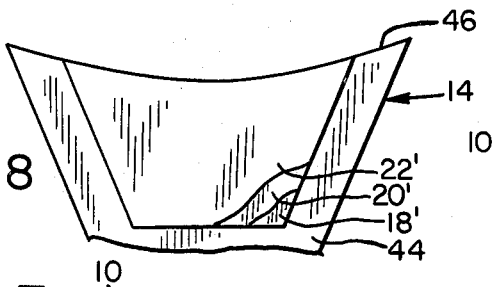
FIG. 8
FIG. 7
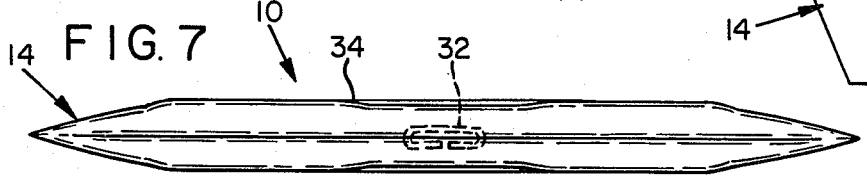

DISPOSABLE GARMENT SHIELD AND METHOD OF MANUFACTURE

BACKGROUND OF THE INVENTION

The present invention relates to a disposable garment shield and method of manufacture, and particularly to a garment shield which is easily adapted to fit the underarm of the user without requiring multiple, shaped component parts and expensive manufacturing processes.

A garment shield or a dress shield is a comparatively well-known attachment for a dress or other article of apparel and is adapted to be placed on the underside of the sleeve protecting the garment from perspiration, discoloration and the like. Some devices of this type have been made of cloth and were sewn into the garment, although more recently proposed garment shields have been formed of disposable material and can be adhered to the garment with some type of adhesive layer. Although useful, the cost of employing garment shields may not be warranted unless such cost is very low.

An adequate shield should shape to the underarm of the garment and be comfortable in use without distorting the garment or becoming noticeable from the exterior of the garment. Prior garment shields have frequently been made from two half-moon shaped sections joined together along a curved line so as to fit the curve of the garment sleeve. However, the manufacture of these shields including the joinder thereof with the various layers involved can be undesirably costly.

SUMMARY OF THE INVENTION

In accordance with the present invention, in a preferred embodiment thereof, a disposable garment shield having a first side adapted to be secured to the garment and a second moisture absorbent side is folded, with the second side inwardly, up to a location longitudinally removed from the fold line and preferably midway between the edges of the shield. The sides are secured together at such location and then reversely folded to expose the second side while causing the shield to be depressed between lateral ends of the fold line to provide a concavity adapting the shield to fit the underarm of the user.

The shield is preferably formed from a plurality of layers including a base layer of fusible interfacing, an absorbent layer, and a moisture barrier layer between the base layer and the absorbent layer. Preferably a fourth layer of porous, non-woven polyester material is superimposed over the other layers and secured to the base layer. After folding, the shield can be ironed onto the garment but can be easily removed as desired.

The various layers including the base layer are preferably approximately hexagonal in shape and can be derived from a larger sheet of material in nested relation.

The securing of the layers together at the aforementioned location displaced from the fold line is preferably accomplished by stapling.

It is accordingly an object of the present invention to provide an improved garment shield which is economical in manufacture.

It is another object of the present invention to provide an improved garment shield which is efficacious in accomplishing the intended purpose and which is easily attached to the garment being protected.

It is another object of the present invention to provide an improved garment shield of enhanced efficacy in absorbing moisture and protecting a garment being worn.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a perspective view of a garment shield according to the present invention illustrating the positioning of the same relative to the sleeve of a garment;

FIG. 2 is a view of a side of a garment shield, normally disposed away from the garment, in a preliminary stage of manufacture;

FIG. 3 is a cross-sectional view illustrating various layers of a garment shield according to the present invention;

FIG. 4 is illustrative of the manner in which a number of garment shield layers or separate shields can be economically obtained from sheet material;

FIG. 5 is a side view of a garment shield according to the present invention having additional or absorbent layers folded inwardly and illustrating securing of said layers in folded condition;

FIG. 6 is a side view of the garment shield according to the present invention in reversely folded or finished condition exposing the absorbent layers and illustrating a depression or concavity adapted to fit the underarm of the user;

FIG. 7 is a top end view of the reversely folded garment shield of FIG. 6; and FIG. 8 is a side view of a garment shield according to the present invention adapted for use with a sleeveless garment.

DETAILED DESCRIPTION

Referring to the drawings, a garment shield 10 according to the present invention is adapted to be positioned as illustrated in FIG. 1 in secured relation to the sleeve area of the garment 12 being worn and under the arm of the user. The shield includes a base layer 14 which is adherable to the garment. The garment shield is disposable and the base layer desirably comprises fusible interfacing formed of cellulosic material having an adhesive applied thereto, at least one the side 16 intended to come in contact with the garment. A particular product suitable in this regard is known as Shirt-Fuse manufactured by Stacy Fabrics Corporation, New York, N.Y.

The base layer 14 carries a second layer 18 of plastic sheeting material forming a moisture barrier. A suitable material comprises approximately 0.015 mil thick polyethylene sheeting. This sheeting is secured to the base layer, for example by means of a spray-applied adhesive or hot melt adhesive. Over the sheeting 18 is located a layer 20 of absorbent fibrous material preferably comprising cottom batting, although other absorbent material such as multi-layers of absorbent paper tissue may be substituted. A deodorant may be incorporated in the absorbent layer. Superimposed above the absorbent layer is a fourth layer 22 comprising a thin, porous, non-woven polyester material such as manufactured by The Kendall Co., 1 Federal St., Boston, Mass. 02101.

Layer 22, intended to contact the body of the user, is designed to avoid lint problems or other fraying of the absorbent layer 20 in use while permitting moisture to pass therethrough to the absorbent layer 20. The layer 22 is suitably slightly larger than layers 18 and 20 thereunder, leaving a marginal edge 24 which is secured, as by employing spray or hot melt adhesive, to the underlying base layer 14. The layer 22 thus secures the underlying layers in place. Alternatively all the layers may simply be glued together in which case it is not vital there be any marginal edge 24 around layer 22.

The shield is symmetrical about a common fold line 26, transverse to the shield, wherein the shield portions on either side of said fold line are each trapezoidal and symmetrical about a longitudinal centerline, the shield having parallel ends 28 and 30 shorter than and parallel to fold line 26. The shield thus takes the shape of a somewhat elongated hexagon. Not only is the base layer 14 configured in such a shape, but also the superimposed layers 18, 20 and 22 conveniently have a similar and proportionally smaller shape, centrally disposed on the base layer and symmetrical with respect to fold line 26. As a consequence, the various components of the shield are conveniently produced in nested relation as illustrated in FIG. 4, enabling ease and economy of manufacture utilizing a folding machine.

Further, in manufacture of the shield according to the present invention, the symmetrical halves of the shield are folded toward one another along fold line 26 with layers 18, 20 and 22 disposed inwardly. The shield in the thus folded condition is illustrated in FIG. 5. Means are applied for securing the layers permanently together in folded relation up to a point part way along the longitudinal extent of the layers, and approximately central between the lateral edges of the shield. Such point is typically defined by the particular means securing the layers together. In the illustrated embodiment, a metal staple 32 is driven through the layers and secured on the opposite side of the shield. Other securing means may be substituted, for example the layers may be stitched together at the point identified by staple 32, or alternatively the two halves of layer 22 may be held by adhesive at or up to this point, with it being understood the underlying layers are similarly adhered together in such case.

The two ends 28 and 30 of the shield are then spread apart and the shield is reversely folded from the location of staple 32 as illustrated in FIG. 6. The reverse folding may be accomplished by the eventual user of the shield, or the device may be reversely folded prior to packaging if so desired. In any case, the reverse folding exposes the inner layers and causes the shield to be depressed as indicated at 34 in FIG. 6 between lateral ends 36 and 38 of fold line 26, forming a concavity at 34 adapting the shield to fit the underarm of the user. Subsidiary folds 40 and 42 are provided which extend approximately from the location of staple 32 to the lateral ends 36 and 38 of fold line 26. As will be seen, the fold line 26 also assumes a somewhat curved or concave configuration as illustrated in FIG. 6.

The layers, since multiply folded, provide a thicker end configuration which is somewhat troughed as illustrated in FIG. 7, but in any case form a wider end region for moisture absorption. The most important factor, however, is the curved or concave configuration allowing the shield to fit the body of the wearer without requiring special configurations for the two halves of the shield and without requiring a joinder of curved configurations after manufacture or cutting thereof from sheet material.

In employing the dress shield according to the present invention, the shield is applied to the underarm of the garment, i.e. substantially as shown in FIG. 1, through the application of heat to the base layer comprising fusible interfacing. The base layer is "ironed on" with a comparatively cool iron applied or pressed against the marginal area 44 on the same side of the base layer as the centrally located layers 18, 20 and 22. Consequently, side 16 will become adhered to the inside sleeve and inside body of the garment. A relatively cool iron is employed for facilitating easy removal of the dress shield after use. In particular, the lowest temperature setting of the average iron is suitable, i.e. a temperature of approximately 270° F.

The shield according to the present invention is also adapted for use with a sleeveless garment. As illustrated in FIG. 8, the garment shield as hereinbefore described can merely be severed as by cutting with a pair of scissors along a line 46 which would be located in juxtaposition with fold line 26 in FIG. 6. The cut is in the form of a shallow semicircle. Two shields suitable for use with a sleeveless garment are thereby produced from one garment shield as hereinbefore described. Line 46 can be trimmed as appropriate to avoid any portion of the shield that might otherwise show through the garment armhole. The shield is "ironed on" to the garment around marginal area 44 in the same manner as hereinbefore described. While a shield adapted for a sleeveless garment is thus suitably formed by severing the first described shield into two parts, it is understood shields for sleeveless garments can be originally manufactured according to the pattern of FIG. 8 if so desired.

The shield of FIG. 8 further illustrates a construction according to the present invention wherein the layer 22' formed of porous material is the same size as underlying absorbent layer 20' and moisture barrier layer 18', the layers being glued together without overlying marginal edges but otherwise being formed from substantially the same materials as in the first described embodiment.

The dress shield according to the present invention has the advantages of very economical production from sheet material components without requiring extensive fabricating steps to achieve the desired form fit. Instead, the shield is merely folded as hereinbefore described and stapled or otherwise secured at a central location facilitating the reverse folding into the concave shape for fitting the garment and arm of the user.

While I have shown and described plural embodiments of my invention, it will be apparent to those skilled in the art that many other changes and modifications may be made without departing from my invention in its broader aspects. I therefore intend the appended claims to cover all such changes and modifications as fall within the true spirit and scope of my invention.

I claim:

1. A disposable garment shield for positioning under the arm of the user in the sleeve area of a garment being worn, said shield having a first side adapted to be secured to the garment being worn and a second moisture absorbent side, said shield having a transverse fold line thereacross, said shield being folded toward said second side from said fold line up to a location longitudinally removed from said fold line, and reversely folded beyond said location exposing said second side and causing said shield to be depressed between lateral ends of said fold line forming a concavity adapting said shield to fit the underarm of the user.

2. The shield according to claim 1 wherein said location is approximately centrally positioned between lateral edges of said shield, said shield as reversely folded forming subsidiary folds extending approximately from said central location to lateral ends of said transverse fold line.

3. The shield according to claim 1 including means for securing said shield sides together at said location.

4. The shield according to claim 3 wherein said securing means comprises a staple.

5. The shield according to claim 3 wherein said securing means comprises stitching.

6. The shield according to claim 3 wherein said securing means comprises adhesive material.

7. A disposable garment shield adapted to be positioned under the arm of the user in secured relation to the sleeve area of a garment being worn, said shield comprising:

a first base layer of flexible material provided with adhesive adapted to attach said base layer to said garment, a second moisture barrier layer disposed over said base layer and superimposed by a third layer of absorbent fibrous material, said shield having a transverse fold line thereacross, said shield being folded from said fold line to a point longitudinally removed therefrom, with said second and third layers located inwardly, adapting said shield to be reversely folded beyond said point causing said shield to be depressed between lateral ends of said fold line forming a concavity adapting said shield to fit the underarm of the user.

8. The shield according to claim 7 wherein said shield is trapezoidal and symmetrical on either side of said fold line having ends parallel to and shorter than said fold line adapting the components of said shield to be produced in nested relation from sheet material.

9. The shield according to claim 8 wherein each of said layers is trapezoidal in shape on either side of said fold line.

10. The shield according to claim 7 wherein said second and third layers are smaller than said base layer and disposed within a marginal area of said base layer, said base layer comprising fusible interfacing material adapted to receive heat at least in said marginal area for adhering said base layer to said garment.

11. The shield according to claim 7 wherein said moisture barrier layer comprises polyethylene sheeting.

12. The shield according to claim 7 further including a fourth layer of porous non-woven polyester material superimposed over said second and third layers.

13. The shield according to claim 12 wherein said fourth layer around the margin thereof is adhered to said base layer.

14. A disposable garment shield adapted to be positioned under the arm of the user in secured relation to the sleeve area of a garment being worn, said shield comprising:

a first base layer of flexible material provided with adhesive adapted to attach said base layer to said garment, at least one additional layer disposed over said base layer for facilitating the absorption of moisture, said shield having a transverse fold line thereacross, and means securing said shield in folded relation from said fold line with said additional layer inwardly up to a point part way along the longitudinal extent of said shield from said fold line and approximately centrally between lateral edges of said shield causing the shield to be depressed between lateral ends of said fold line forming subsidiary folds between said securing means and the lateral ends of said fold line providing a concavity adapting said shield to fit the underarm of the user.

15. The shield according to claim 14 wherein said securing means comprises a staple.

16. The shield according to claim 14 wherein said shield is trapezoidal and symmetrical on either side of said fold line having ends parallel to and shorter than said fold line.

17. The method of manufacturing a disposable garment shield comprising:

cutting a base layer from a sheet of cellulosic material, superimposing at least one additional layer of absorbent material over said base layer and adhering the same to the base layer, folding said base layer with said additional layer inwardly up to a point part way along the longitudinal extent of said base layer from the fold, securing said layers together at said point, and reversely folding said layers from said point to provide a concavity between lateral ends of the fold adapting the shield to fit the underarm of a user.

18. The method according to claim 17 including preparing said base layer in common with a plurality of similar items by severing the same in nested relation from a sheet of cellulosic material.

19. The method according to claim 18 wherein said layer is cut in hexagonal pattern.

20. The method according to claim 18 including preparing said additional layer from material in common with a plurality of similar items by severing the same from the last mentioned material in nested relation.

21. The method according to claim 20 wherein said additional layer is cut in hexagonal pattern.

22. A disposable garment shield adapted to be positioned under the arm of the user in secured relation to the sleeve area of a garment being worn, said shield comprising:

a first base layer of flexible material adapted to be attached to said garment, a layer of absorbent fibrous material secured over said base layer on one side of said base layer, wherein said layer of absorbent fibrous material is smaller than said base layer and disposed within a marginal area of said base layer, said base layer comprising fusible interfacing material adapted to receive heat at least in said marginal area from the side of said base layer carrying said layer of absorbent fibrous material for adhering said base layer to said garment

23. The shield according to claim 22 including a moisture barrier layer secured between said base layer and said layer of absorbent fibrous material.

24. The shield according to claim 23 further including a layer of porous non-woven polyester material secured in superimposed relation over said layer of absorbent fibrous material.

25. The shield according to claim 12 being folded to expose said layer of absorbent fibrous material along a concave fold line adapted to fit the underarm of the user.

26. The shield according to claim 25 being trapezoidal in shape on each side of said fold line.

27. The shield according to claim 22 being adapted for securing to a sleeveless garment having a curved upper edge for substantially matching the armhole of such garment.

28. The shield according to claim 27 being trapezoidal in shape below said upper edge.

* * * * *